US006123896A

United States Patent [19]

Meeks, III et al.

[11] Patent Number: 6,123,896

[45] Date of Patent: Sep. 26, 2000

[54] TEXTURE FREE BALLISTIC GRADE TANTALUM PRODUCT AND PRODUCTION METHOD

[75] Inventors: Henry S. Meeks, III, Roseville; Marc A. Fleming, Rancho Cordova; Lucile Lansing, Sacramento, all of Calif.

[73] Assignee: Ceracon, Inc., Riverbank, Calif.

[21] Appl. No.: 09/239,268

[22] Filed: Jan. 29, 1999

[51] Int. Cl.[7] ..... B22F 3/12

[52] U.S. Cl. ..... 419/49; 75/245; 102/306; 419/38

[58] Field of Search ..... 419/49, 38; 75/245; 102/306

[56] References Cited

U.S. PATENT DOCUMENTS

| | | | |
|---|---|---|---|
| 3,699,642 | 10/1972 | Lange | 29/497.5 |
| 4,499,048 | 2/1985 | Hanejko | 419/49 |
| 4,499,049 | 2/1985 | Hanejko . | |
| 4,501,718 | 2/1985 | Bradt | 419/49 |
| 4,539,175 | 9/1985 | Lichti et al. . | |
| 4,640,711 | 2/1987 | Lichti et al. . | |
| 4,766,813 | 8/1988 | Winter et al. | 102/307 |
| 5,032,352 | 7/1991 | Meeks et al. . | |
| 5,279,228 | 1/1994 | Ayer | 102/306 |
| 5,331,895 | 7/1994 | Bourne et al. | 102/307 |
| 5,522,319 | 6/1996 | Haselman, Jr. | 102/306 |
| 5,549,731 | 8/1996 | Cline et al. | 75/244 |
| 5,792,977 | 8/1998 | Chawla | 102/307 |

*Primary Examiner*—Daniel J. Jenkins
*Attorney, Agent, or Firm*—William W. Haefliger

[57] ABSTRACT

A process of consolidating tantalum metal powder to essentially random texture by pressing a preform in a bed of flowable pressure transmitting particles, and the product thereby produced.

16 Claims, 2 Drawing Sheets

TEXTURE FREE BALLISTIC GRADE TANTALUM PRODUCT AND PRODUCTION METHOD

BACKGROUND OF THE INVENTION

This invention relates generally to powder preform consolidation processes, and more particularly to such processes wherein consolidated tantalum powder parts are produced. The use of higher density metals such as tantalum for replacement of copper in the fabrication of explosively formed penetrators (EFP's) and shape charge liners (SCL's) is of considerable interest in the field of ballistic devices. However, certain metallurgical, fabrication and cost related issues currently limit the use of tantalum for task specific ballistic applications.

The conventional fabrication technique for sheet and plate is ingot metallurgy followed by standard thermomechanical metal working practices such as forging and rolling. These fabrication processes, however, produce highly undesirable textured microstructure which yield anisotropic static and dynamic properties over both low and high strain rate regimes. Machining of the tantalum plate or sheet stock to its final EFP or SCL geometry contributes not only to an additional loss of ductility through work hardening mechanisms, but also adds significant cost to the final product.

The role of texture on microstructure development and dynamic mechanical properties has been recognized by a number of investigators ([1–4]). Several common metal working practices such as extrusion, rolling and forging have undergone careful scrutiny as methods of producing ballistic grade tantalum. These studies have shown that the presence of a <111> texture orientation improves formability (ductility) of the tantalum metal. However, these thermomechanically oriented processes also cause the tantalum to exhibit an anisotropic mechanical behavior due to the creation of a non-uniform texture. Through orientation distribution function (ODF) analysis forged and rolled tantalum is found to exhibit a pole density of 5X random. This non-uniform texture is known to have deleterious effects on the high-strain rate performance of the EFP which results in both an uneven collapse of the tantalum body upon impact, and the subsequent generation of unpredictable fin configurations.

SUMMARY OF THE INVENTION

It is a major object of the invention to provide a powder metallurgy (p/m) process overcoming the above problems associated with tantalum processing. The process of the invention is capable of producing a fine grain, virtually texture free, ballistic grade tantalum with significantly improved high strain rate properties, with the forged material exhibiting more uniform mechanical behavior under high strain rate regimes (4000 $S^{-1}$) than its thermomechanically processed predecessor. Tantalum processed via the herein disclosed powder metallurgy approach provide a higher level of performance over conventionally processed ingot material even if the oxygen content of the powder processed tantalum is two or three times higher than the upper limit of 100 ppm currently established for ballistic application. Orientation distribution analysis of the forged powder metallurgy processed tantalum confirms a <111> texture of only 2.8X random. Additionally, there is very little preferred orientation and no significant difference between the texture in directions perpendicular to a normal plane. The herein disclosed process provides for a reliable and reproducible manufacturing alternative for high quality, dynamically predicable, ballistic grade tantalum.

Basically, the process of consolidating tantalum metal powder includes the steps:

a) pressing said powder into a preform, and preheating the preform to elevated temperature, b) providing a bed of flowable pressure transmitting particles, c) positioning the preform in such relation to the bed that the particles encompass the preform, d) and pressurizing the bed to compress said particles and cause pressure transmission via the particles to the preform, thereby to consolidate the preform in to a desired shape, e) such pressurizing being carried out to effect a <111> texture of less than about 3.0X random.

Another object of the invention includes effecting consolidation pressurization over a time interval of sufficient shortness that said <111> texture is less than about 2.8X random. Such pressurization is typically effected at levels greater than 100,000 psi for a time interval of less than about 30. Additionally, pressurization can be effected at levels greater than about 80,000 psi for a time interval of less than about 30 seconds.

Yet another object includes providing a sealed, evacuated, deformable metallic container in the bed, and locating the preform in the container with bed particles both inside the container and outside the container, prior to pressurization. Bed particles outside the container are typically pressurized to deform the container and transmit pressurization to bed particles in the container. In this way, oxygen access to the tantalum preform is virtually eliminated, to provide a more ductile material.

An additional object is to provide an improved tantalum product, produced by the method or methods of the invention, as referred to. Such a consolidated powder metal preform product is characterized by substantially completely random grain textural orientation. For example, the product consolidated preform typically has a <111> texture of less than about 3.0X random.

These and other objects and advantages of the invention, as well as the details of an illustrative embodiment, will be more full understood from the following specification and drawings, in which:

DRAWING DESCRIPTION

DETAILED DESCRIPTION

Figure 1:
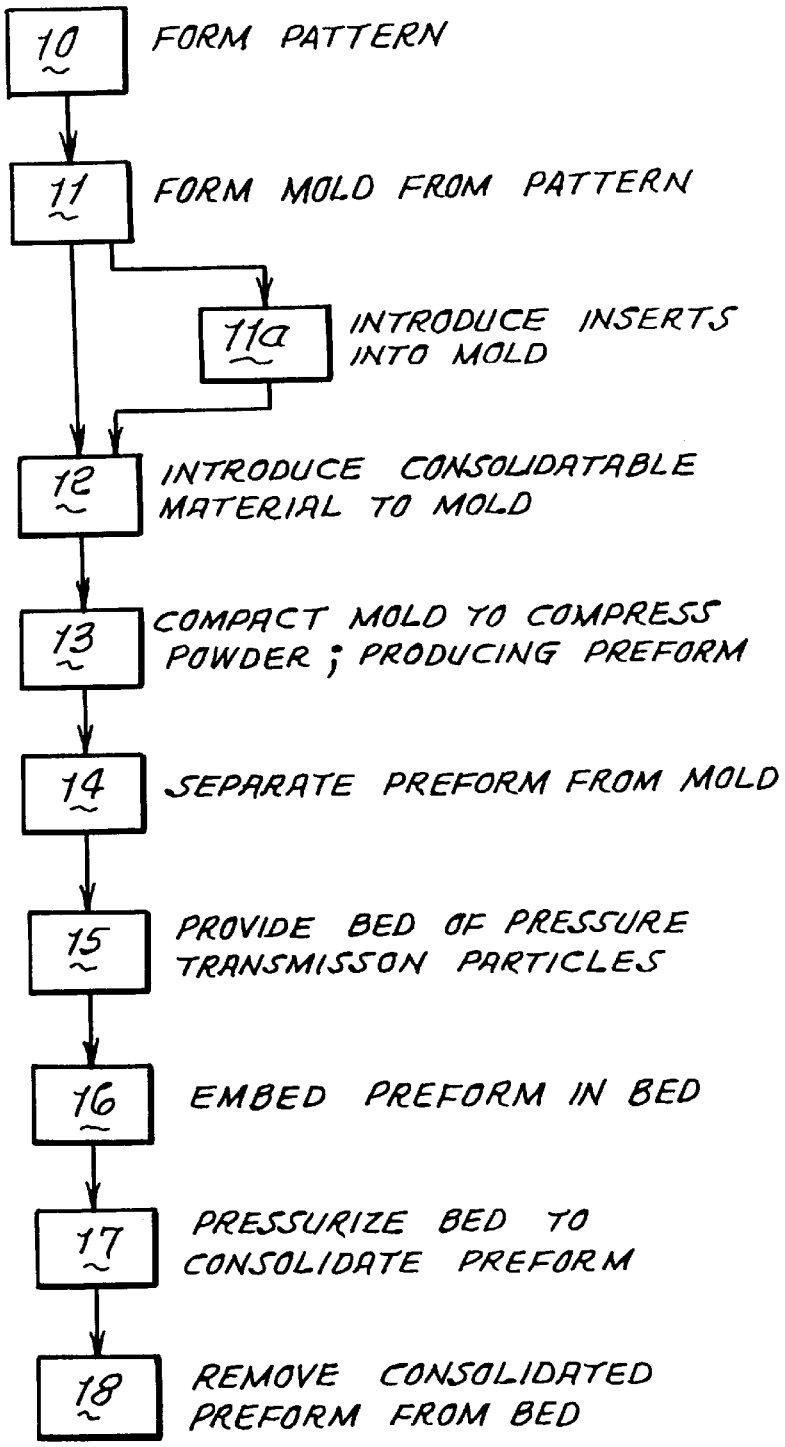
FIG. 1 is a flow diagram.

Referring to FIG. 1, a preferred process includes forming a pattern, which may for example be a scaled-up version of the tantalum part ultimately to be produced. This step is indicated at 10. Such a part may be one capable of highly accurate ballistic travel. Step 11 in FIG. 1 constitutes formation of a mold by utilization of the pattern; as described in U.S. Pat. No. 5,032,352 incorporated herein by reference.

Step 11*a* constitutes the introduction of a previously formed shape, insert or other body into the mold. The shapes may be specifically or randomly placed within the mold. Step 11*a* may be eliminated if inserts are not used.

Step 12 of the process constitutes introduction of consolidatable tantalum powder material to the mold, as for example introducing such powder into the mold interior.

Step 13 of the process as indicated in FIG. 1 constitutes compacting the mold, with the powder, inserts, or other body(s) therein, to produce a powder preform. A preform typically is about 80–85% of theoretical density, but other densities are possible. The step of separating the preform from the mold is indicated at 14 in FIG. 1.

Steps 15–18 in FIG. 1 have to do with consolidation of the preform in a bed of pressure transmitting particles, as for example in the manner disclosed in any of U.S. Pat. Nos. 4,499,048; 4,499,049; 4,501,718; 4,539,175; and 4,640,711, the disclosures of which are incorporated herein by reference. Thus, step 15 comprises provision of the bed of particles (carbonaceous, ceramic, or other materials and mixtures thereof). Step 16 comprises embedding of the preform in the particle bed, which may be pre-heated, as the preform may be; step 17 comprises pressurizing the bed to consolidate the preform; and step 18 refers to removing the consolidated preform from the bed. The preform is typically at a temperature between 1,050° C. and 1,350° C. prior to consolidation. The embedded powder preform is compressed under high uniaxial pressure typically exerted by a ram, in a die, to consolidate the preform to up to full or near theoretical density.

Figure 2:
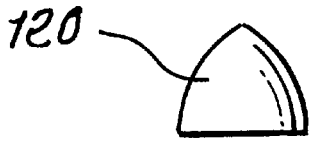
FIG. 2 is a representation of a consolidated tantalum part, having a shape for ballistic travel.
Figure 3:
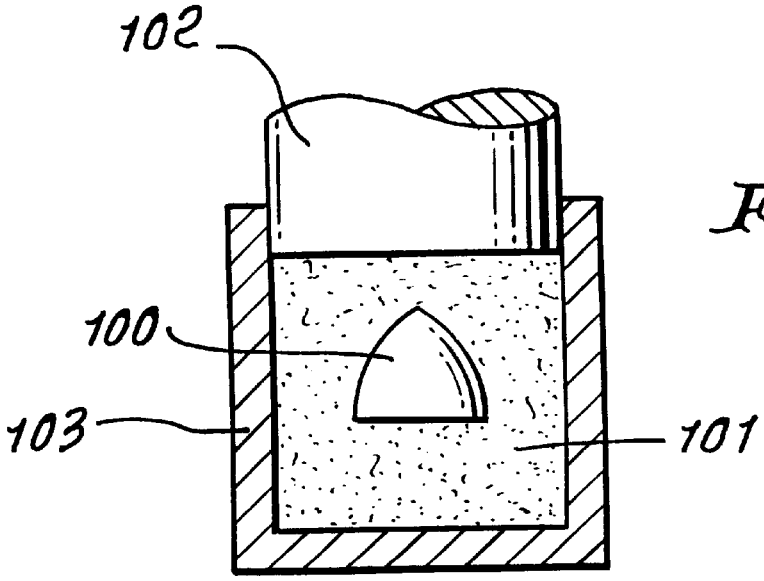
FIG. 3 shows pressurization of a preform.

FIG. 3 shows a tantalum preform 100 surrounded by a bed 101 of pressure exertion particles subjected to consolidation pressurization as by a ram 102. A consolidation die 103 contains the particles. The consolidated conical preform is shown at 120 in FIG. 2. Shapes other than conical are usable, such as cylindrical or dive-shaped, and FIG. 2 may be considered to represent same.

Figure 4:
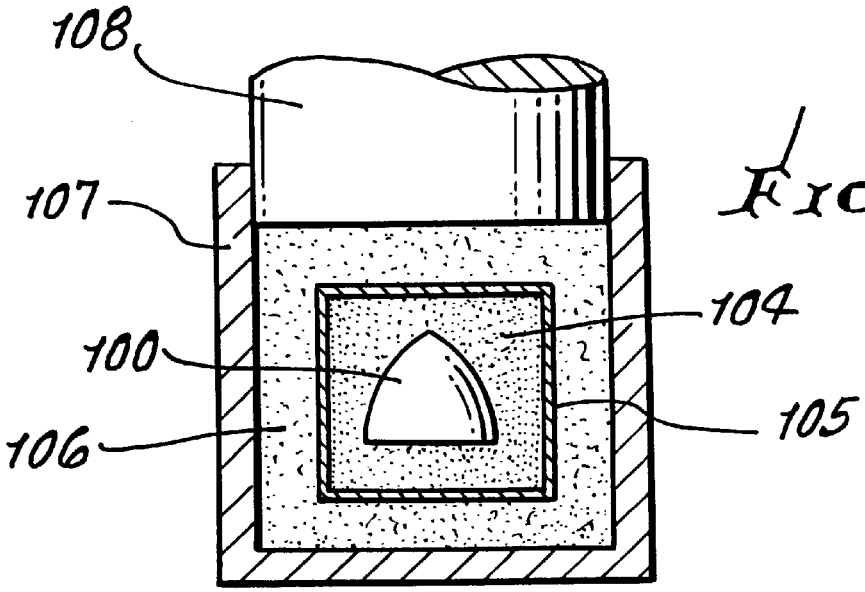
FIG. 4 shows pressurization of a preform in a sealed case.

FIG. 4 shows the preform 100 surrounded by an inner bed 104 of pressure exertion particles filling a deformable metallic can or container 105. An outer bed 106 pressure exertion particles surrounds the can, and a consolidation die 107 contains the particle. A pressure exertion ram 108 pressurizes bed 106, which pressurizes the can 105, which deforms and in turn pressurizes bed 104 to consolidate the preform. In this way, oxygen is excluded from access to the preform, during consolidation.

Additional features of the present process for producing the tantalum part having random grain orientation texture include:

1) rapidly completed consolidation pressurization, i.e. high pressure held for less than about 30 seconds, for rapid densification of the heated powdered tantalum.

2) High maximum consolidation pressure of about 100,000 to 200,000 psi, to be held for less than about 30 seconds.

3) High maximum consolidation pressurization to achieve or effect a <111> texture of less than 3.0X random, and preferably about 2.8X random of the consolidated object.

4) Use of a sealed, container or can to contain the tantalum preform within an inner particulate bed, and an outer particulate bed to surround the can, during consolidation pressurization. Air is evacuated from the can.

5) Heating of the preform to temperature in excess of 1,000 C., prior to consolidation, for example between 1,050 C. and 1,350 C.

6) Use of carbonaceous, ceramic and/or other known pressure transmitting particles. Ceramic particles may incorporate aluminum oxide.

7) Preheating the pressure transmitting particles to elevated temperatures between 1,000 C. and 1,300 C., where preform temperature is kept above bed temperature.

REFERENCES

1. C. Pokross, "Controlling the Texture of Tantalum October 1989, 46–49.
2. C. Feng and P. Kumar, "Correlating Microstructure and Texture in Cold Rolled Tantalum Ingot", Journal of Metals, October 1989, 40–45.
3. A. Michaluk, R. I. Asfahani, and D. C. hughes, "Characterization of Extruded and Forged Tantalum Powder Metallurgy Preforms", High Strain Rate Behavior of Metals and Alloys, edited by R. I. Asfahani, E. Chen, and A. Crowson, 1992.
4. C. A. Kelto, E. E. Timm, and A. J. Pyzik, "Rapid Omnidirectional Compaction (ROC) or Powder", Annual Review of Materials Sciend, (19) 1989, 527–550.

We claim:

1. The method of consolidating tantalum metal powder to form an object, that includes:

a) pressing said powder into a preform, and preheating the preform to elevated temperature b) providing a bed of flowable pressure transmitting particles, c) positioning the preform in such relation to the bed that the particles encompass the preform, d) and pressurizing said bed to compress said particles and cause pressure transmission via the particles to the preform, thereby to consolidate the preform into a desired object shape, e) said pressurizing being carried out to effect a resultant <111> texture of the object of less than about 3.0X random.

2. The method or claim 1 wherein said pressurization is effected over a time interval of sufficient shortness than said resultant texture is less than about 2.8X random.

3. The method of claim 1 wherein said pressurization is effected at levels greater than about 80,000 psi for a time interval of less than about 30 seconds.

4. The method of claim 1 including providing an evacuated and sealed, deformable metallic container in the bed, and locating the preform in the container with bed particles both inside the container and outside the container, prior to said pressurization.

5. The method of claim 4 wherein bed particles outside the container are pressurized to deform the container and transmit pressurization to bed particles in the container.

6. The method of claim 5 wherein said pressurization is effected for a time interval of less than about 30 seconds, and at pressure levels in excess of about 80,000 psi.

7. The method of claim 1 including heating the preform to temperature in excess of 1,000 C. prior to step d.

8. The method of claim 3 including heating the preform to temperature in excess of 1,000 C. prior to step d.

9. The method of claim 4 including heating the preform to temperature in excess of 1,000 C. prior to step d.

10. The method of claim 1 including preheating the pressure transmitting particles, which are one of the following:

i) carbonaceous ii) ceramic iii) mixtures of i) and ii), or with other pressure transmitting materials.

11. The method of claim 10 wherein the pressure transmitting particles in the bed are preheated to elevated temperatures between 1,000 C. and 1,300 C.

12. The method of claim 1 wherein the preform is pre-heated to elevated temperature between 1,050 C. and 1,350 C.

13. The method of claim 1 wherein the preheated preform is positioned in said bed, the particles of which are at elevated temperatures.

14. The consolidated tantalum object produced by the method of claim 1.

15. The consolidated tantalum object produced by the method of claim 8.

16. The consolidated tantalum object produced by the method of claim 9.

* * * * *